United States Patent [19]

Montet

[11] Patent Number: 4,872,096

[45] Date of Patent: Oct. 3, 1989

[54] MECHANISM FOR LOCKING AND UNLOCKING A LAMP IN A LAMP HOLDER PARTICULARLY FOR USE IN AN AUTOMOBILE VEHICLE

[75] Inventor: Maurice Montet, Paris, France

[73] Assignee: Valeo Vision, Cedex, France

[21] Appl. No.: 296,667

[22] Filed: Jan. 12, 1989

[30] Foreign Application Priority Data

Jan. 15, 1988 [FR] France ..... 88 00402

[51] Int. Cl.[4] ..... H01R 33/00

[52] U.S. Cl. ..... 362/226; 362/83; 362/310; 362/382

[58] Field of Search ..... 16/373, 380; 24/489, 24/517, 518; 362/80, 83, 310, 382, 226, 436, 437, 438, 440, 458

[56] References Cited

U.S. PATENT DOCUMENTS 4,614,997 9/1986 Montet ..... 362/382
4,670,822 6/1987 Baker ..... 362/226

FOREIGN PATENT DOCUMENTS 1313934 11/1961 France .
2099977 3/1972 France .
1233592 5/1971 United Kingdom .
1256485 12/1971 United Kingdom .
2064747 6/1981 United Kingdom .

*Primary Examiner*—Stephen F. Husar
*Attorney, Agent, or Firm*—Wenderoth, Lind & Ponack

[57] ABSTRACT

The invention provides a mechanism for retaining a bulb in position in a lamp holder of a reflector. The lamp holder comprises a circulat bearing surface for engagement by the flange of a bulb, and the mechanism comprises a spring clip pivotally mounted on one side of the lamp holder and having cranked legs adapted to bear against the bulb flange. The spring clip is adapted to engage a catch element on the opposite side of the lamp holder which comprises a lamp engageable by the end of the spring clip, which terminates in a catch. The catch element also incorporates a release ramp facing the catch. On fitting of the bulb, pressure on the spring clip towards the opening causes the clip to side over the ramp and engage the catch, thereby to secure the bulb. Removal of the bulb is acheived by pressure on the spring clip in the same direction, which causes the clip to slide over the release ramp and pass out of the catch element, thereby releasing the bulb.

10 Claims, 3 Drawing Sheets

MECHANISM FOR LOCKING AND UNLOCKING A LAMP IN A LAMP HOLDER PARTICULARLY FOR USE IN AN AUTOMOBILE VEHICLE

FIELD OF THE INVENTION

The present invention relates to a mechanism for locking and unlocking a lamp in a lamp holder, more especially for a lighting or indicator device for an automobile vehicle.

BACKGROUND OF THE INVENTION

A lighting or indicator device of this kind usually comprises a lamp which is fitted inside a casing which may act as a reflector, through an opening in the rear of the reflector and which is locked into the lamp holder.

One of the arrangements currently used for locking and unlocking the lamp consists of a circular collar on the lamp holder against which is applied a circular flange of the lamp, and securing the lamp by means of a spring element made of steel wire. Means of articulating the spring element are provided on the lamp holder, and means for hooking on and for releasing the said spring element are provided in a region of the lamp holder substantially diametrically opposite the articulating means.

The ends of the steel wire constituting the spring element are disposed in the locking and unlocking means in such a way that its release is effected by squeezing the ends in a direction perpendicular to the axis of insertion of the lamp in the reflector. Such means are effective and of simple design, and are described, for example, in French patent Nos. FR 1 313 934 and FR 2 036 783 (GB No. 1256485).

Nevertheless, such a device has the disadvantage of requiring a large working space behind the lamp because the ends of the steel wire constituting the spring element are off-set relative to the axis of insertion of the lamp and must be compressed by hand or by a tool to lock or unlock the lamp.

Moreover, in some cases, such a design enables the spring element to drop down under its own weight against the locking and unlocking means, which may mislead the user into believing that the lamp is secured.

An object of the present invention is to overcome these disadvantages by proposing a simple, effective system for releasably locking a lamp in a lamp holder, requiring only a minimum space for manipulation.

SUMMARY OF THE INVENTION

The invention comprises an arrangement for locking and unlocking a lamp in a lamp holder, more especially for a lighting or indicating device suitable for an automobile vehicle, comprising a reflector having a circular opening in its rear part for a lamp fitted with a circular flange to pass through, a lamp holder comprising a bearing surface around the opening, and means for locking and unlocking the lamp consisting substantially of a spring element, one end of which is articulated on the lamp holder and the other, free end of which is adapted to hook onto a substantially diametrically opposite region of the opening, the central part of the spring element bearing on the lamp so as to apply its circular flange against the bearing surface of the lamp holder, characterized in that the means for locking and unlocking the lamp comprise at least one attachment, disposed opposite the attachment point for the spring element and incorporating a guiding ramp and a catch, said guiding ramp being adapted to guide and deform the free end of the spring element when a pressure is exerted in a direction substantially the same as the axis of insertion of the lamp, during the locking operation until the said spring element anchors itself under said catch, regaining its initial shape as it does so; and a concave release ramp facing the catch, adapted to guide and deform the spring element when a second pressure similar to the first is exerted in the same direction during the unlocking operation until the said spring element is freed.

According to another characteristic of the invention the articulated end of the spring element comprises means for the automatic return thereof to the open position.

The following description, which made with reference to the attached drawings, describes a non-limiting embodiment of the invention.

DESCRIPTION OF THE PREFERRED EMBODIMENTS

Figure 1:
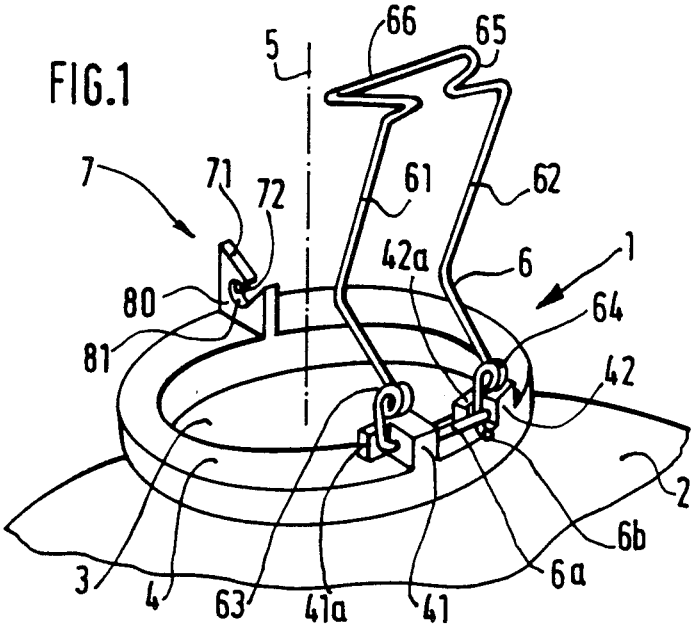
FIG. 1 is a perspective view of a lamp holder in accordance with the invention, in the open position.
Figure 2:
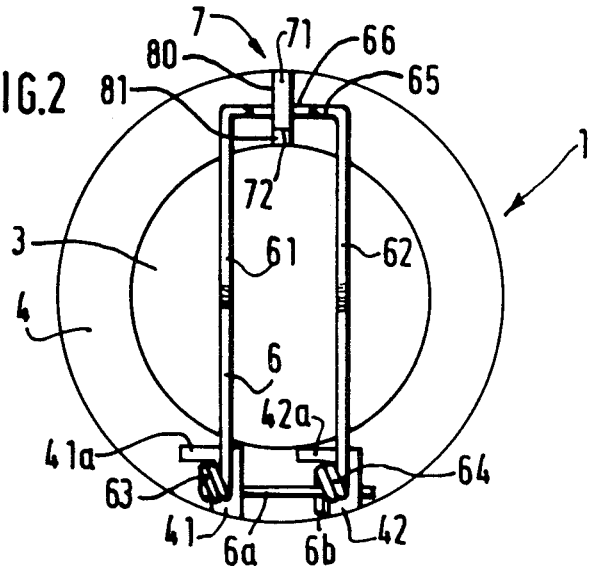
FIG. 2 show the lamp holder of FIG. 1, in the closed position, in elevation.

A lamp holder 1 is produced by moulding integrally with a reflector 2 or is attached to the said reflector 2, which comprises an opening 3 in its rear part. The lamp holder 1 comprises a circular bearing surface 4 provided to bear against the circular flange of a lamp (not shown), adapted to be housed inside the reflector 2, on insertion of the lamp through the opening 3 along the axis 5. The lamp is locked in its position by means of a spring element 6 made of shaped wire, preferably of steel.

The spring element 6 consists of two cranked legs 61 and 62 connected together by an omega-shaped free part 65 comprising a rectilinear base 66. The ends 6*a* and 6*b* of the legs 61 and 62 of the wire constituting the spring element 6 are attached to the lamp holder 1 through "L"-shaped fixing and bearing elements 41 and 42 derived from the material of, or made by moulding with, the lamp holder 1 and provided on the bearing surface 4. There is a hole through each of the elements 41 and 42 through which passes the end 6*a* of the spring element 6, bent at 90° relative to the leg 62 and sufficiently long to pass through the fixing and bearing elements 41 and 42. The other end 6*b* of the wire element is immobilized between an arm 42*a* of the element 42 and the 6*a*, perpendicularly to the latter. Springs 63 and 64 are formed by forming at least one turn in the wise bearing on the arms 41*a* and 42*a* of the respective elements 41 and 42, in order to constitute an articulation, and to return and hold the said spring element 6 in a normally open position as shown FIG. 1.

Means for locking and unlocking the lamp, by hooking onto and sealing the spring element 6 are made in one piece with the lamp holder 1 on its bearing surface 4 in a region 7 approximately diametrically opposite the fixing and bearing elements 41 and 42, and they consist of an attachment 80 comprising a guiding ramp 71 and a catch 72 and a concave extraction ramp 81 facing the catch 72. The means for attaching and releasing are adapted for the spring element 6 to hook on, which element, thanks to its cranked legs 61 and 62 bearing against the circular flange of the lamp, locks the lamp on the lamp holder 1, and the means are also adapted to release the spring element 6 to unlock the lamp from the lamp holder 1.

The different stages of locking and unlocking the lamp will now be described with reference to FIGS. 3*a* to 3*f*.

When the lamp is positioned in the lamp holder 1 by applying its circular flange 9 against the bearing surface 4 (FIG. 3*a*), the spring element 6 is in the open position and is held there by the springs 63 and 64 bearing on the elements 41 and 42 respectively.

Figure 3A:
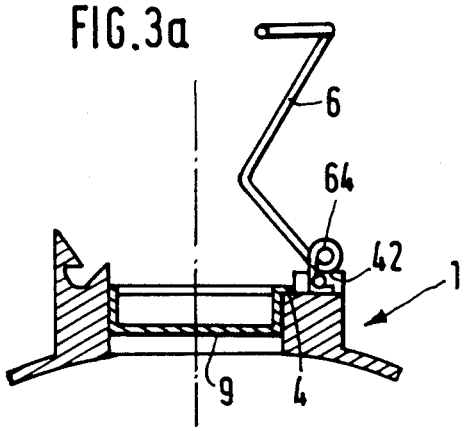
FIGS. 3*a* to 3*f* show the stages of locking and unlocking the lamp by hooking the spring element on the lamp holder and releasing it from the lamp holder.
Figure 3B:
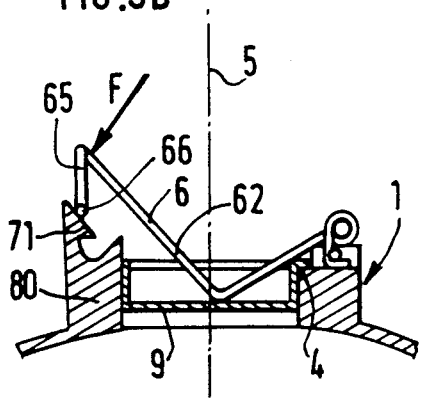
Figure 3C:
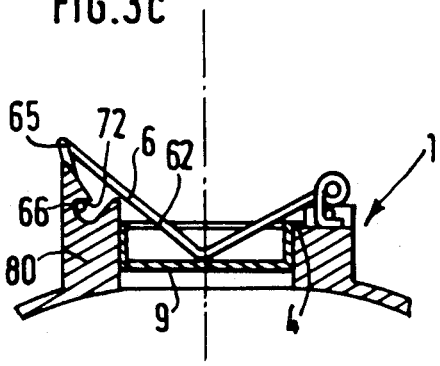
Figure 3D:
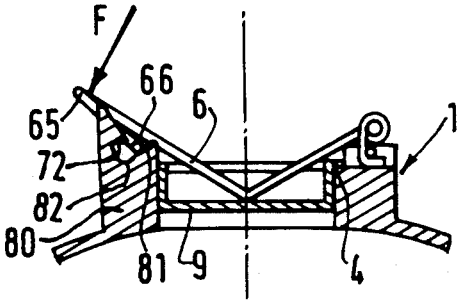
Figure 3E:
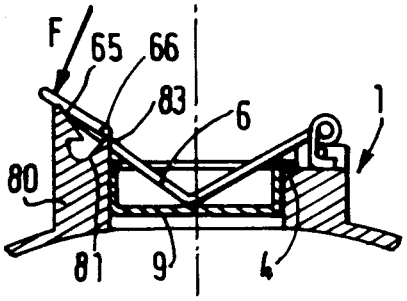
Figure 3F:
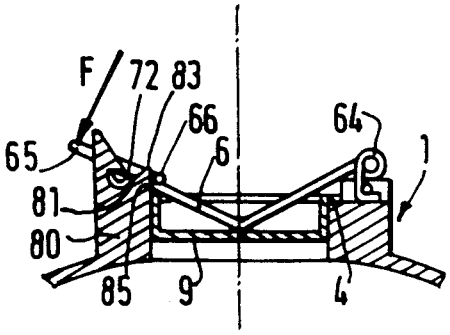

To lock the lamp into position with the spring element 6, the operator exerts a pressure in the direction of the arrow "F", which is substantially parallel to the axis of insertion 5 of the lamp into the lamp holder 1 (FIG. 3*b*). The cranked legs 61 and 62 bear on the circular flange 9 of the lamp, and the horizontal base 66 of the omega-shaped part 65 comes into contact with the guiding ramp 71 of the attachment 80, and slides over the said guiding ramp 71 causing a deformation of the spring element 6, and more specifically of the omega-shaped part 5, until its base 66 hooks on to the catch 72 (FIG. 3*c*), thus resuming its initial shape. The lamp is thus locked into the lamp holder 1 as a result of the cranked legs 61 and 62 which exert a pressure on the circular flange 9 of the lamp.

Release of the spring element 6, and consequently unlocking of the lamp, is effected in the same way as its locking, that is to say by exerting a pressure in the direction of the arrow "F" (FIG. 3*d*), the effect of which is to bring the base 66 of the omega-shaped part 65 into contact with the concave release ramp 81 of the attachment 80, the said base firstly sliding over the descending part of the concave release ramp 81, to reach the lowest part 82 of the ramp 81 and then sliding on its upwardly-directed part. It will be noted that, in order to do this, the distance between the catch 72 and the lowest part 82 of the concave release ramp 81 must be at least equal to the diameter of the wire forming the base 66 of the omega-shaped part 65.

When the base 66 of the omega-shaped part 65 has reached the upper part 83 of the release ramp 81 (FIG. 3*e*), on maintaining the pressure in the direction of the arrow "F", the base 66 escapes from the release ramp 81 and bears on the outer face 85 of the attachment 80. The operator then releases the pressure on the spring element 6, which is deformed at this stage, the springs 63 and 64 automatically returning the spring element 6 into its open position as shown in FIG. 3*a*. It will be noted that in order to avoid the base 66 of the omega-shaped part 65 being caught on the catch 72, it si necessary that the height of the upper part 83 of the concave release ramp 81 should be at equal to that of the catch 72.

Figure 4:
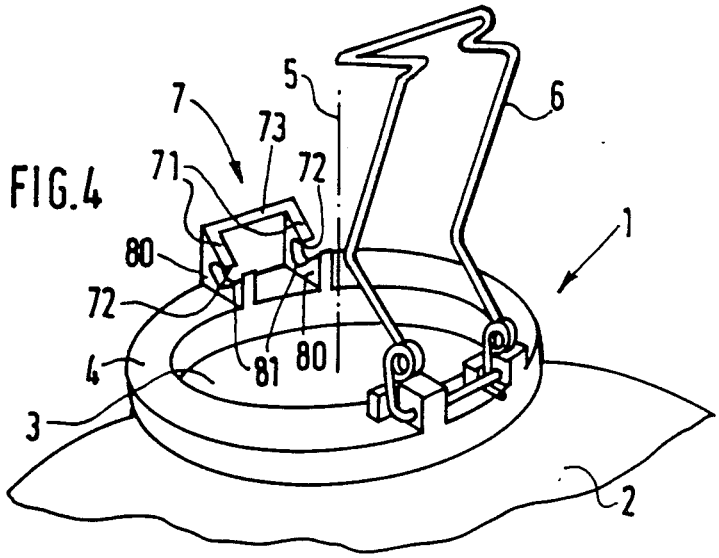
FIG. 4 shows a second embodiment of a lamp holder in accordance with the invention, in perspective.

In accordance with another embodiment of the invention shown in FIG. 4, the means for locking and unlocking the lamp consist of two attachments 80 each comprising a guiding ramp 71, a catch 72, and a concave release ramp 81 facing the corresponding catch 72. The attachments 80 are fastened together by a wall 73 to make the assembly more rigid. This embodiment provided improved stability of the spring element 6 when the operator exerts a pressure for the attachment or release of the spring element 6, especially when the axis of pressure "F " does not pass through the attachment 80.

Figure 5:
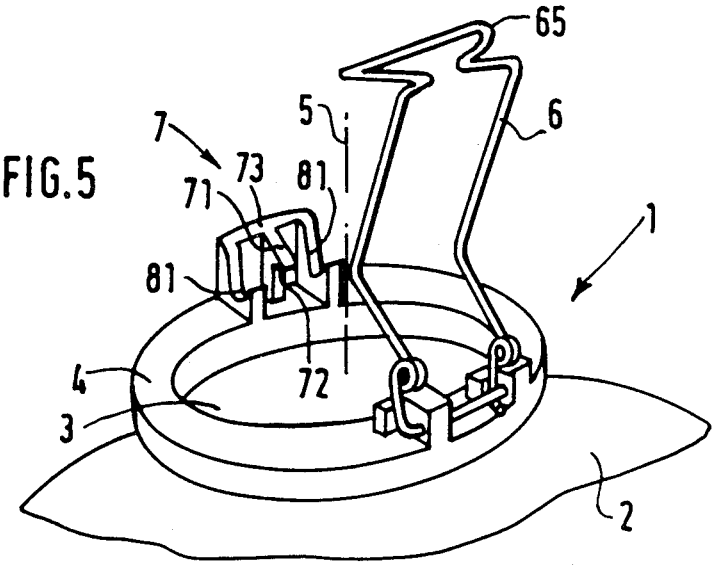
FIG. 5 shows the preferred embodiment of a lamp holder in accordance with the invention, in perspective.

According to the preferred embodiment of the invention shown in FIG. 5, a single guiding ramp 71 and a single catch 72 are provided on the lamp holder 1, and on either side of these two concave release ramps 81 are also provided, disposed facing a plane passing through the beak 72. The guiding ramps 71, the catch 72 and the concave release ramps 81 are fastened together by a wall 73 in order to make the assembly more rigid.

A configuration of this kind provides improved stability of the spring element 6. In practice, the pressure required for hooking the spring element 6 onto the catch 72 is sufficiently weak to permit attachment even if the pressure "F" is exerted along an axis not passing through the guiding ramp 71 and the catch 72. On the other hand, the pressure required for release of the spring element 6 is slightly greater, as a result of the greater deformation of the omega-shaped part 65, and necessitates good stability of the said spring element 6, obtained by the two concave release ramps 81, separated from one another.

The direction and the point of application of the pressure necessary for these operations (shown by the arrow "F") is an example, the pressure "F" having to be applied near the omega-shaped part 65 and in a direction substantially parallel to the axis of insertion of the lamp into the lamp holder 1. This has the advantage of enabling insertion of the lamp and its locking in a minimal space, which is the volume necessary just for insertion of the lamp in the lamp holder 1.

The description is given here solely by way of example and modification could be made without departing from the scope of the invention as set out in the appended claims.

What is claimed is:

1. A mechanism for locking and unlocking a lamp in a lamp holder of the kind comprising a reflector having a circular opening in its rear part for a lamp equipped with a circular flange to pass through, and a lamp holder comprising a bearing surface extending around the opening, said mechanism comprising a spring element, one end of which is articulated on the lamp holder and the other, free, end of which is adapted to hook into at least one attachment disposed substantially diametrically opposite of the opening, the central part of the spring element bearing on the lamp in order to apply its circular flange to the bearing surface of the lamp holder, wherein said attachment comprises means for locking and unlocking the lamp constituted by a guiding ramp and a catch, said guiding ramp being adapted to guide and deform the free end of the spring element when a pressure is exerted, substantially in the same direction as the direction of insertion of the lamp, during the locking operation until the said spring element anchors itself under the catch, regaining its initial shape as it does so; and a concave release ramp facing said catch and adapted to guide and deform the spring element when a second pressure similar to the first is exerted in the same direction during the unlocking operation until the said spring element is freed.

2. A locking and unlocking mechanism according to claim 1, wherein the distance between the lowest part of the concave release ramp and the catch is at least equal to the diameter of the wire constituting the spring element.

3. A locking and unlocking mechanism according to claim 1, wherein the height of the highest point of the concave release ramp is at least equal to that of said catch.

4. A locking and unlocking mechanism according to claim 1, wherein said spring element is a wire forming two cranked legs articulated from the lamp holder and connected together to form a generally omega-shaped part, the base of which constitutes the free end of the spring element.

5. A locking mechanism according to claim 1, wherein two attachments are provided each comprising a release ramp respectively facing two catches.

6. A locking and unlocking mechanism according to claim 1, wherein a guiding ramp and a catch are disposed between two concave release ramps facing a plane passing through said catch.

7. A locking and unlocking mechanism according to claim 1, wherein said articulated end of the spring element comprises means for automatic return to the open position.

8. A locking and unlocking mechanism according to claim 7, wherein said automatic return means comprise at least one spiral spring formed by shaped the wire constituting the spring element.

9. A locking and unlocking mechanism according to claim 8, wherein elements for attaching the spring element and providing bearings for the spiral springs are formed on the lamp holder.

10. A locking and unlocking mechanism according to claim 1, wherein the locking and unlocking means, and the attachment and bearing means for the spring element, are unitary with the lamp holder, which itself is in one piece with the reflector.

* * * * *

UNITED STATES PATENT AND TRADEMARK OFFICE

CERTIFICATE OF CORRECTION

PATENT NO. : 4,872,096

DATED : October 3, 1989

INVENTOR(S) : Maurice MONTET

It is certified that error appears in the above-identified patent and that said Letters Patent is hereby corrected as shown below:

On the Cover Page, in the title:
Change "AUTOMOBILE" to --AUTOMOTIVE--.

On the Cover Page, in the Abstract:
Line 3 thereof, change "comprises a circulat" to --includes a circular--;
Line 4, change "the" (first occurrence) to --a-- and change "a" to --the--;
Line 5, change "comprises" to --includes--;
Line 8, after "element" insert --which is--;
Line 9, change "which comprises a lamp" to --and which includes a ramp--;
Line 10, change ", which terminates" to --and terminating--;
Line 13, change "opening" to --lamp--.

Column 1, line 4 (the title), change "AUTOMOBILE" to --AUTOMOTIVE--;
line 10, change "mobile" to --motive--;
line 20, delete "securing the lamp by means of";
line 21, after "wire" insert --for securing the lamp-- and change "of" (second occurrence) to --for--;
line 23, delete "said";
line 64, change "," to --.--;
line 65, change "characterized in that the" to --The--;
line 68, change ", said" to --. The--.

Column 1, lines 53-54, change "automobile" to read --automotive--;
Column 1, line 66, change "comprise" to read --comprises--.

UNITED STATES PATENT AND TRADEMARK OFFICE

CERTIFICATE OF CORRECTION

PATENT NO. : 4,872,096

DATED : October 3, 1989

INVENTOR(S) : Maurice MONTET

It is certified that error appears in the above-identified patent and that said Letters Patent is hereby corrected as shown below:

Column 2, line 1, change "being" to --is--;
line 5, delete "said" (both occurrences) and after "catch," insert --the spring element--;
line 6, change "; and a" to --. A--;
line 7, change "facing" to --faces-- and after "catch," insert --and is--;
line 9, change "the" (third occurrence) to --an--;
line 10, delete "said";
line 16, delete "which";
line 17, delete "a";
line 24, change "shows" to --is an elevation view of--;
line 25, delete ", in elevation";
line 26, change "show the" to --are sectional views showing--;
line 27, change "the" (first and second occurrences) to --a--;
line 29, change "shows" to --is a perspective view of--;
line 30, delete ", in perspective";
line 31, change "shows the" to --is a perspective view of a--;
line 32, delete ", in perspective";
line 37, delete "said";
line 38, change "comprises" to --includes--;
line 39, change "comprises" to --has--;
line 40, change "the" to --a--.
line 61, change "wise" to --wire to--;
line 62, change "bearing" to --bear--.

Column 2, line 16, change "embodiment" to --embodiments--

Column 2, line 64, delete "said".

UNITED STATES PATENT AND TRADEMARK OFFICE

CERTIFICATE OF CORRECTION

PATENT NO. : 4,872,096

DATED : October 3, 1989

INVENTOR(S) : Maurice MONTET

It is certified that error appears in the above-identified patent and that said Letters Patent is hereby corrected as shown below:

Column 3, line 6, change "hook on, which" to --be hooked, which spring--;
line 27, delete "the" (second occurrence);
line 28, delete "said";
line 36, delete "its";
line 41, delete "said".

Column 4, line 9, change "of these" to --thereof are provided-- and delete "are";
line 10, delete "also provided";
line 11, change "beak" to --catch--;
line 23, delete "said";
line 24, change "," to --that are--;
line 35, delete "is" and after "here" insert --is--;
line 36, after "made" insert --thereto--;
line 40, change "A" to --In a--;
line 47, delete "," after "free";
line 49, after "diametrically" insert --on the-- and change "the" (second occurrence) to --a--;
line 50, change "the" (first occurrence) to --said--;
line 52, change "means" to --:--;
line 53, indent to start new paragraph, before "for" insert --means-- and change "constituted by" to --and including--;
line 58, change "the" (first occurrence) to --a-- and delete "the" (second occurrence);
line 59, change "the catch," to --said catch, said spring element--;

UNITED STATES PATENT AND TRADEMARK OFFICE

CERTIFICATE OF CORRECTION

PATENT NO. : 4,872,096

DATED : October 3, 1989

INVENTOR(S) : Maurice MONTET

It is certified that error appears in the above-identified patent and that said Letters Patent is hereby corrected as shown below:

Column 4, line 60, delete "a concave release ramp facing";
line 61, indent to start new paragraph and before "said" insert --a concave release ramp facing--;
line 63, change "the" (second occurrence" to --an--;
line 64, delete "the".
line 66, change "the" (first occurrence) to --a--;
line 67, change "the" (both occurrences) to --said--

Column 5, line 1, change "the" (second occurrence) to --a--;
line 4, change "the" (third occurrence) to --said--;
line 11, change ", the" to --having a-- and change "the" (second occurrence) to --said--;
line 14, after "two" insert --said--;
line 15, delete "respectively" and change "two catches" to --a respective catch--;
line 17, change "a" (both occurrences) to --said--.

Column 6, line 1, after "two" insert --said--;
line 5, after "return" insert --of said spring element--;
line 9, change "shaped the" to --shaping a--;
line 13, change "the" to --said--;
line 16, change "the" to --said-- and delete "," after "means";

UNITED STATES PATENT AND TRADEMARK OFFICE

CERTIFICATE OF CORRECTION

PATENT NO. : 4,872,096

DATED : October 3, 1989

INVENTOR(S) : Maurice MONTET

It is certified that error appears in the above-identified patent and that said Letters Patent is hereby corrected as shown below:

Column 6, line 17, change "the" (first occurrence) to --said--;

line 18, delete "," after "ment".

Signed and Sealed this

Nineteenth Day of March, 1991

*Attest:*

HARRY F. MANBECK, JR.

*Attesting Officer*

*Commissioner of Patents and Trademarks*